United States Patent [19]

Lewis et al.

[11] 4,411,145

[45] Oct. 25, 1983

[54] CAN-MAKING METHOD

[75] Inventors: Leon L. Lewis, Butler Township, Butler County; Michael V. Murray, Monroeville Borough, both of Pa.

[73] Assignee: United States Steel Corporation, Pittsburgh, Pa.

[21] Appl. No.: 340,561

[22] Filed: Jan. 18, 1982

Related U.S. Application Data

[62] Division of Ser. No. 155,272, Jun. 2, 1980.

[51] Int. Cl.[3] ..... B21D 22/28; B21D 51/26

[52] U.S. Cl. ..... 72/42

[58] Field of Search ..... 72/41, 42, 46, 347, 72/348, 349; 252/25, 28, 29, 49.3, 49.5

[56] References Cited

U.S. PATENT DOCUMENTS

| | | | |
|---|---|---|---|
| 3,250,103 | 5/1966 | Beaubien et al. | 72/42 |
| 3,287,264 | 11/1966 | Topper | 72/42 X |
| 3,577,753 | 5/1971 | Shah et al. | 72/41 |
| 3,655,349 | 4/1972 | Shah et al. | 72/42 X |

*Primary Examiner*—Ervin M. Combs

*Attorney, Agent, or Firm*—William L. Krayer

[57] ABSTRACT

A drawing and ironing process is disclosed for making unitary can bodies from blackplate, or non-tinned steel, utilizing a novel composition comprising finely-divided molybdenum disulfide, an acrylic ester/acrylic acid polymer and a polyethylene or similar wax, in an aqueous medium.

11 Claims, No Drawings

CAN-MAKING METHOD

This is a division of application Ser. No. 155,272, filed June 2, 1980.

BACKGROUND OF THE INVENTION

While a number of possible approaches have been suggested to permit the substitution of blackplate for tinplate in the manufacture of drawn and ironed unitary can bodies, none has been commercially attractive.

We have developed a technique which utilizes a novel composition as a lubricant for can-making from blackplate without requiring any change in equipment from a conventional tinplate D&I operation. Our composition comprises (1) an acrylic acid/acrylic ester polymer, (2) a wax, and (3) finely-divided molybdenum disulfide. It also desirably employs a temporary cross-linking agent of the type disclosed in Rogers U.S. Pat. No. 3,308,078 to act as a binder for the $MoS_2$, and an emulsifier/stabilizer.

Combinations of molybdenum disulfide and binders, such as carboxymethylcellulose with amine-functional silanes, have been proposed for metal working. See U.S. Pat. No. 3,843,529 and U.S. Pat. No. 3,881,048, wherein the $MoS_2$ is also used in combination with graphite. Various other fine abrasives have been proposed—see Montgomery U.S. Pat. No. 2,112,632.

The concept of "binding" a solid lubricant such as $MoS_2$ to a substrate for metal-working lubrication is discussed in the Oct. 1, 1973 issue of Chemical Engineering, pages 56–66. Various synthetic resins have been proposed, such as celluloses and acrylics, for amenability to curing in air. Others, such as phenolics, epoxies, silicones, and polyimides are heat-cured.

Water-soluble resins such as acrylic acid/acrylic ester resins have also been proposed for drawing and ironing, in combination with waxes and with certain metal oxides. See Derwent Basic Abstract 79838X/43.

The reader may also be interested in U.S. Pat. No. 3,287,264, which employs acrylic polymers, condensation resins, wax, and $MoS_2$ in an organic solvent, U.S. Pat. No. 3,250,103, which describes petroleum and paraffin waxes used in combination with various polymers for metal working, U.S. Pat. No. 3,478,554 suggesting the use of polyethylene as a lubricant, and Parkinson U.S. Pat. No. 3,873,458 proposing an ammonium aqueous-based lubricant comprising polymers of ethylene and carboxylic acid-containing monomers and molybdenum disulfide. Certain inorganics have also been suggested. But, so far as we are aware, no one has found a composition which can accommodate the demanding conditions of can-making by drawing and ironing.

To be effective and commercially attractive, a lubricant composition must dry quickly and "set" or cure firmly to retain the solid component. If the lubricant is not dry and firm, it will tend to rub off the cup wall or will migrate to the inside of the cup during the cupping operation (tending to inhibit stripping) and/or will abrade off the bottom of the cup onto the conveyor. It should not be immediately water-soluble or susceptible to being washed off by plain water or ironing coolant.

Of all common metal-working processes, such as wire-drawing, deep drawing, and the like, the process of drawing and ironing cans is generally conceded to be the most demanding. In the use of tinplate, the tin tends to act as a solid lubricant; without tin, it has been extremely difficult to make even a few cans without scoring and galling.

Typically, the kinds of problems which can develop with a poor lubricant are excessive scoring and galling of the outside can wall surface, failure to produce smooth, highly polished surfaces, and metal pickup on the dies.

SUMMARY OF THE INVENTION

Our invention comprises a composition useful for drawing and ironing blackplate to make "two-piece" cans, and the method of making such cans using our composition.

By a two-piece can, we mean, as will be recognized by practitioners of the art, a can having a unitary body and a top. The body is made by first forming a "cup" and then ironing the cup to a longer thinner-walled container shape typified by the common beverage can. The equipment for performing the drawing and ironing process is well known in the art, but its use, as mentioned above, has been generally limited to tinplate.

The composition we use has three basic ingredients in addition to a water carrier—an acrylic (addition) polymer, a wax, and finely divided $MoS_2$. It also desirably includes a cross-linking agent which can be solubilized easily and an emulsifier or stabilizer.

The acrylic or addition polymer will desirably be a copolymer of about 5–35% by weight acrylic or methacrylic acid and about 65–95% by weight of an acrylic or methacrylic acid or methacrylic lower ester, having a molecular weight from about 500 to about 1,000,000 or more. The carboxylic acid component of the polymer is of course hydrophilic, and the polymer lends itself well to use in an aqueous medium; the monomers and polymers formed therefrom are described in U.S. Pat. No. 3,308,078, column 5, line 6 to column 13, line 62, which description is incorporated herein by reference. We do not intend, in the portion of the polymer not containing carboxylic acid, to be limited to acrylic monomers. The monomers not containing carboxylic acid groups can include up to about 25 mole percent (based on the whole polymer) of such other readily copolymerizable monomers as vinyl acetate, styrene, acrylonitrile, and N-vinyl pyrrolidone, including ethylenically unsaturated monomers selected from the group consisting of monomers having the structural formulas:

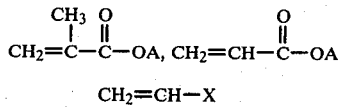

$$CH_2{=}\overset{CH_3}{\overset{|}{C}}{-}\overset{O}{\overset{\|}{C}}{-}OA,\ CH_2{=}CH{-}\overset{O}{\overset{\|}{C}}{-}OA$$

$$CH_2{=}CH{-}X$$

and mixtures thereof wherein A is an organo radical having from about one to about ten carbon atoms, and X is an organo radical selected from the group consisting of aryl and alkaryl radicals. We may use any addition polymer, which may or may not be used in the presence of a "fugitive cation", having a molecular weight of about 500 to about 1,000,000 or more described in U.S. Pat. No. 3,308,078, column 14, line 48 to column 17, line 8, hereby incorporated herein by reference.

The wax can be a paraffinic, castor, or other organic was including synthetic waxes such as a low molecular weight (500–2,500 or higher) polyethylene, or mineral waxes such as ozocerite, animal and insert waxes such as beeswax, vegetable waxes, such as carnauba wax, and waxy amides, such as "Armowax" and the like, i.e. any waxy substance. Commercial drawing waxes such as "Wax-draw 150 and Wax-draw 700" can be used either in our polymer-containing composition and/or as the wax composition for the inside of the can, although an oil may be used for the inside, as is known in the art.

The molybdenum disulfide must be finely divided, but its efficiency is not appreciably improved by using particles more fine than technical grade, a grade having a nominal particle size of four microns which may include particles up to 100 microns. Up to 90% of the $MoS_2$ may be replaced with lubricant graphite, preferably having a particle size of 99% 0.7 micron (−325 mesh). In preparing the composition, the dry acrylic and $MoS_2$ may be ground together prior to the addition of aqueous carrier. Likewise, the cross-linker may be made by dissolving zinc acetate, for example, in aqueous ammonia.

In addition to the above three ingredients, we may optionally use an alkali soluble resin, such as the resin/maleic anhydride adducts with polyols described in U.S. Pat. No. 3,308,078, column 13, line 63 to column 14, line 43, which reads as follows:

"The molecular weight of the alkali soluble resins of the invention is critical in that outside the number average molecular weight range of up to about 5,000 certain resin cuts of the invention will not perform satisfactorily in the coating compositions of the invention.

"A suitable molecular weight of a specific alkali soluble resin is in part dictated by its chemical composition. For example, suitable condensation polymerization resins which can be used in the coating compositions of the invention have molecular weights from about 600 to about 1400. In a preferred embodiment, the molecular weight can range from about 600 to about 800. In a particularly preferred embodiment, the molecular weight is about 700. These resins include certain polynuclear substances such as rosin/maleic anhydride adducts which are condensed with polyols such as ethylene glycol, propylene glycol, pentaerythritol, neopentyl glycol and mixtures thereof.

"Examples of commercially available condensation polymerization resins suitable for use in the coating compositions of the invention which are rosin/maleic anhydride adducts condensed with polyols include:

"(a) Durez 19788 and 15546 resins which have molecular weights of about 720 and 1,000 and acid numbers of about 200 and 140 respectively. Additional Durez resins include: Durez 17211 which has a molecular weight of about 950 and an acid number of about 150; Durez 23965 which has a molecular weight of about 720 and an acid number of about 140, and Durez 23971 which has an acid number of about 150.

"(b) Shanco L-1165 which has a molecular weight of about 600 and an acid number of about 190, Shanco L-1165S which has a molecular weight of about 600 and an acid number of about 190, Shanco 60-61 which has a molecular weight of about 650 and an acid number of about 210, Shanco L-1177 which has an acid number of about 200, Shanco 60-72 which has a molecular weight of about 720 and an acid number of about 200, Shanco 60-85 which has an acid number of about 190, Shanco 60-58 which has a molecular weight of about 660 and an acid number of about 215, Shanco 64-29 which has an acid number of about 195, Shanco L-1180 which has an acid number of about 180, Shanco L-1174 which has an acid number of about 140, Shanco 60-96 which has an acid number of about 193, Shanco 60-97 which has an acid number of about 198, Shanco 60-98 which has an acid number of about 188.5, Shanco 64-77 which has an acid number of about 167, Shanco 64-73 which has an acid number of about 200, Shanco 64-75 which has an acid number of about 202, Shanco 64-79 which has an acid number of about 204, and Shanco 64-23 which has an acid number of about 128.

"(c) Schenectady SR-88 which has a molecular weight of about 780 and an acid number of about 190, and Schenectady SR-91 which has an acid number of about 185.

"(d) Alresat 618C has an acid number of about 180.

"(e) Nelio VBR-7055 which has an acid number of about 200.

"(NOTE: Where molecular weight is not stated, it is below about 5,000.)"

We find that cross-linking agents of the type described in U.S. Pat. No. 3,308,078 can perform the highly desirable function of "curing" the coating of lubricant on the surface, i.e. making it relatively hard and ductile. These compositions are fully described in columns 17–20 of the above-mentioned U.S. patent, and may be expressed by the formula $M(NH_3)_nY_2$ wherein M is a metal selected from the group consisting of Zn, Cd, Cu, Ni, and mixtures thereof, n is the coordination number of said metal and is an integer from four to six, Y is an equivalent of a carboxyl-containing anion selected from the group consisting essentially of carbonate, formate, acetate, said resin, said polymer, and mixtures thereof in a concentration sufficient to provide a mole ratio of metal ions to total organic film former ligand equivalents, i.e. carboxylic acid groups, ($M^{++}/COO^-$) from about 0.075 to about 0.500.

Suitable metal-fugitive ligand complexes which can be ideally represented by the structural formula $M(NH_3)_nY_2$ (wherein M, n, and Y are as defined above and include the ammonia complexes of zinc, cadmium, copper and nickel ions). It is understood that n represents the coordination number of the metal ion. The $NH_3$ moiety comprises the fugitive ligand of the complex. It is understood that these stable, metal-fugitive ligand complexes in the aqueous coating compositions of the invention will probably not be exactly as shown ideally above. For example, water of hydration may alter the values of n in certain complexes. These metal-fugitive ligand complexes have these essential compartments including:

(a) the metal ion, i.e., $Zn^{++}$, $Cd^{++}$, $Cu^{++}$, or $Ni^{++}$, which is the bridging group that is capable of undergoing ligand transfer;

(b) a fugitive ligand, such as ammonia, $NH_3$, which readily converts under certain conditions to a volatile gas; and (c) an anion such as acetate, formate, carbonate and/or organic film former such as resin and/or polymer and mixtures thereof.

The metal-fugitive ligand complexes can be prepared from various water soluble metal salts. For example, salts having the formula $MY_2$ wherein Y is an anion such as acetate and M is as defined above. Aqueous solutions of the ammonia complexes of these metal salts can be readily prepared by adding aqueous ammonia to aqueous solutions of these salts. These aqueous ammonia metal salt solutions can be ideally represented as $M(NH_3)_nY_2$. It is to be understood that in these aqueous ammonia metal salt solutions, water and/or hydroxyl ions may replace some of the ammonia ligands. These solutions can then be added directly to the aqueous coating compositions of the invention.

The oxides of these metals, which are water insoluble, can also be used in the aqueous coating compositions of the invention. To form water soluble metal-fugitive ligand complexes from these oxides requires that the oxides be dissolved in the alkaline resin cut containing an excess of ammonia. These metal oxide/-resin/excess ammonia solutions are desirable since in this manner a metal-fugitive ligand complex can be added to the coating compositions of the invention without introducing an extraneous anion such as an acetate anion. It has been observed that the presence of these anions limits the addition of film forming aids such as wax and the like to the coating compositions of the invention. These anions reduce the stability of coating compositions containing such substances. Of course, when the oxides of the metal M are used the anion, Y, of the metal-fugitive ligand complex $M(NH_3)_nY_2$ will be a resin or polymer ion.

Where the anion of the complex $M(NH_3)_nY_2$ forms a volatile weak acid as does an acetate anion, maximum chemical resistance of the film is achieved rapidly at room temperature. The odor of the volatile acetic acid given off during film formation is readily apparent.

These compositions have the ability to effect cross-linking among the carboxylic acid moieties of the acrylic polymer as the coating dries and the ammonia component of the cross-linker volatilizes. After the ironing process, the cross-links are dissolved as a result of the action of the alkaline cleaner.

The above-described composition can be placed on the side of the sheet which will become the outside of the can, and dried. The potential inside of the can may be coated with a simple wax comprising paraffin or other composition, preferably in an emulsion. The blank is then formed by conventional machinery into a "cup" and subsequently ironed to the familiar beverage can shape. Alternatively, our lubricant composition may be placed on the outside of the cup after it is formed rather than before.

The composition can be conveniently placed on the sheet by a gravure or other roll coater, but may also be sprayed or wiped on.

We have manufactured 100,000 cans from blackplate in a test run using varying amounts sufficient to place from 5 mg/ft$^2$ to about 50 mg/ft$^2$ of $MoS_2$ on the surface of a composition comprising 57% ordinary household Johnson's "Glo-Coat", 29% technical grade molybdenum disulfide and 14% "Wax-draw 150", a commercial 17% solids drawing wax of paraffin and castor waxes in an anionic emulsion. This composition was placed on the outside and Wax-draw 700 was used on the inside of the cans. The blackplate was 0.011–0.012 inch thick. Three sizes of cups were made having dimensions of (a) 3.25 inches diameter × 1.25" high, (b) 3.25 inches diameter × 1.375" high, and (c) 2.66 inches diameter × 2.31" high, and reduced in thickness during the ironing operation, in three rings, by 20%, 40%, and 40%. After the ironing process, the cans were cleaned in a solution of a commercial alkaline (pH 11) cleaner, rinsed with tap water, and rinsed again with deionized water and dried prior to lacquering. After lacquering, the cans were comparable to tinplate cans when tested for iron pickup.

Our composition can be varied somewhat within the following limits:

An acrylic polymer comprising:

(a) from about 5% to about 35% by weight of a polymerizable, ethylenically unsaturated monomer having the structural formula

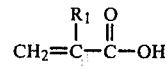

wherein $R_1$ is selected from the group consisting of hydrogen and a methyl radical and (b) from about 65% to about 95% by weight of at least one ligand-free, polymerizable, ethylenically unsaturated monomer selected from the group consisting of monomers having the structural formulas:

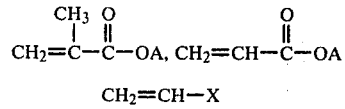

and mixtures thereof wherein A is an organo radical having from about one to about ten carbon atoms, and X is an organo radical selected from the group consisting of aryl and alkaryl radicals. The acrylic polymer should be present in a weight ratio to the wax of about 3 to about 9 parts by weight of the acrylic polymer to from about 1 part to about 20 parts by weight wax (any of the waxes described above).

$MoS_2$, either technical, technical fine, suspension, or any other grade having a nominal particle size no larger than about 5 microns (permitting some up to 100 microns) in an amount from about 15% to about 45% by weight of the entire aqueous composition; the $MoS_2$ may be replaced up to about 90% by graphite.

The emulsifier may be any suitable emulsifying or stabilizing agent, in amounts less than one part by weight effective to provide the desired stability.

The cross-linking agent is as described above and should be present in a concentration sufficient to provide a mole ratio of metal ions to total equivalents ($M^{++}/COO^-$) from about 0.075 to about 0.500.

The solids are dispersed in an aqueous medium to provide about 15% by weight to about 45% by weight $MoS_2$ in the entire aqueous composition.

In addition to the ingredients recited immediately above, we may include from about two to about six parts by weight with the acrylic:wax moiety of a condensation polymerization resin such as a rosin/maleic anhydride adduct condensed with polyols having a molecular weight from about 600 to about 1400, i.e. the weight ratio of acrylic:wax:condensation resin will be (3–9):(1–20):(2–6). With or without the condensation polymerization resin, the organic moiety should comprise about 5–20% of the final aqueous composition and the $MoS_2$ will comprise about 15–45%.

The aqueous composition should be placed on the outside surface of the sheet prior to cupping at a thickness providing from about 5 to about 200 mg $MoS_2$/ft$^2$ of the surface, preferably 20–80 mg $MoS_2$/ft$^2$.

We claim:

1. Method of forming a workpiece of blackplate comprising placing on one surface thereof a coating of a composition comprising, in an aqueous carrier, (A) about 5% to about 20% organic moiety comprising:

(i) in an amount from about 3 parts to about 9 parts by weight of an acrylic polymer comprising:

(a) from about 5% to about 35% by weight of a polymerizable, ethylenically unsaturated monomer having the structural formula

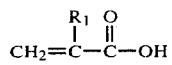

wherein $R_1$ is selected from the group consisting of hydrogen and a methyl radical and (b) from about 65% to about 95% by weight of at least one ligand-free, polymerizable, ethylenically unsaturated monomer selected from the group consisting of monomers having the structural formulas:

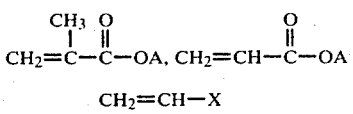

and mixtures thereof wherein A is an organo radical having from about one to about ten carbon atoms, and X is an organo radical selected from the group consisting of aryl and alkaryl radicals, and (ii) about 1 part to about 20 parts by weight of a wax, and (B) about 15% to about 45% finely divided molybdenum disulfide, and (C) in a concentration sufficient to provide a mole ratio of metal ions to total carboxylic acid group equivalents ($M++/COO^-$) from about 0.075 to about 0.500 of a cross-linking agent represented by the formula $M(NH_3)_nY_2$ wherein M is a metal selected from the group consisting of Zn, Cd, Cu, Ni, and mixtures thereof, n is the coordination number of said metal and is an integer from four to six, Y is an equivalent of a carboxyl-containing anion selected from the group consisting essentially of carbonate, formate, and acetate, and forming said workpiece.

2. Method of drawing and ironing cans from blackplate comprising placing on a surface of a blackplate sheet an amount of a composition comprising, in an aqueous medium, (A) about 5% to about 20% organic moiety comprising:

(i) in an amount from about 3 parts to about 9 parts by weight of an acrylic polymer comprising:

(a) from about 5% to about 35% by weight of a polymerizable, ethylenically unsaturated monomer having the structural formula

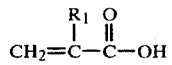

wherein $R_1$ is selected from the group consisting of hydrogen and a methyl radical and (b) from about 65% to about 95% by weight of at least one ligand-free, polymerizable, ethylenically unsaturated monomer selected from the group consisting of monomers having the structural formulas:

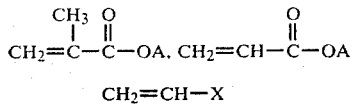

and mixtures thereof wherein A is an organo radical having from about one to about ten carbon atoms, and X is an organo radical selected from the group consisting of aryl and alkaryl radicals, and (ii) about 1 part to about 20 parts by weight of a wax, and (B) about 15% to about 45% finely divided molybdenum disulfide, and (C) in a concentration sufficient to provide a mole ratio of metal ions to total carboxylic acid group equivalents ($M++/COO^-$) from about 0.075 to about 0.500 of a cross-linking agent represented by the formula $M(NH_3)_nY_2$ wherein M is a metal selected from the group consisting of Zn, Cd, Cu, Ni, and mixtures thereof, n is the coordination number of said metal and is an integer from four to six, Y is an equivalent of a carboxyl-containing anion selected from the group consisting essentially of carbonate, formate, and acetate, sufficient to provide about 5 to about 200 mg/ft$^2$ of $MoS_2$ thereon, drying said surface, forming a cup from said sheet with said surface on the outside, and ironing the cup to form a can body.

3. Method of claim 2 including the step of placing a coating of wax on the opposite side of said sheet.

4. Method of claim 2 followed by removing said composition with an aqueous alkaline cleaner, rinsing, and lacquering said can body.

5. Method of claim 2 wherein up to about 90% of the molybdenum disulfide is replaced by lubricant graphite.

6. Method of claim 2 wherein the acrylic polymer contains up to about 25 mole percent of a modifying monomer selected from the group consisting of monomers having the structural formulas:

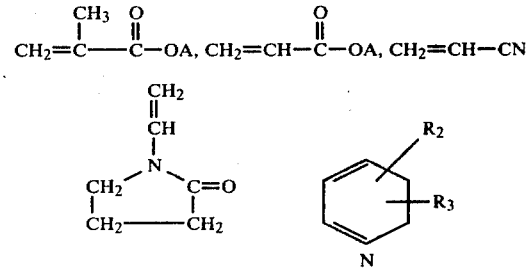

and mixtures thereof wherein A is as defined in claim 10 and $R_2$ is hydrogen or a methyl radical, and $R_3$ is a vinyl radical.

7. Method of claim 2 wherein the cross-linking agent is represented by the general formula $Zn[N(R_2)_3]_4Y_2$ in which $R_2$ is selected from hydrogen and lower alkyl and hydroxyalkyl radicals and Y is an equivalent of a carboxyl-containing anion selected from the group consisting essentially of carbonate, formate, and acetate.

8. Method of claim 2 wherein the wax comprises low-molecular weight polyethylene.

9. Method of claim 2 wherein the organic moiety includes six parts by weight of an alkali-soluble rosin/maleic anhydride adduct with a polyol.

10. Method of claim 2 wherein the composition further includes at least one compatible emulsifying or stabilizing agent.

11. Method of claim 2 wherein the composition contains about 15 to about 45 percent solids.

* * * * *

UNITED STATES PATENT AND TRADEMARK OFFICE

CERTIFICATE OF CORRECTION

PATENT NO. : 4,411,145

DATED : 10/25/83

INVENTOR(S) : Leon L. Lewis and Michael V. Murray

It is certified that error appears in the above-identified patent and that said Letters Patent is hereby corrected as shown below:

Column 2, line 66, "was" should be -- wax --.

Column 2, line 68, "insert" should be -- insect --.

Column 8, line 51, claim 6, change "10" to -- 2 --.

Signed and Sealed this

*Seventh* Day of *February 1984*

[SEAL]

*Attest:*

GERALD J. MOSSINGHOFF

*Attesting Officer*

*Commissioner of Patents and Trademarks*